US009371625B2

(12) United States Patent
Foo et al.

(10) Patent No.: US 9,371,625 B2
(45) Date of Patent: Jun. 21, 2016

(54) MODIFIED SPUDCAN WITH OPTIMAL PERIPHERAL SKIRT FOR ENHANCED PERFORMANCE OF JACKUP OPERATIONS

(71) Applicant: Offshore Technology Development Pte Ltd, Singapore (SG)

(72) Inventors: Kok Seng Foo, Singapore (SG); Chin Kau Quah, Singapore (SG); Okky Ahmad Purwana, Singapore (SG); Michael John Perry, Singapore (SG)

(73) Assignee: Offshore Technology Development Pte Ltd, Singapore (SG)

( * ) Notice: Subject to any disclaimer, the term of this patent is extended or adjusted under 35 U.S.C. 154(b) by 115 days.

(21) Appl. No.: 14/298,975

(22) Filed: Jun. 9, 2014

(65) Prior Publication Data

US 2015/0354164 A1 Dec. 10, 2015

(51) Int. Cl.

| | |
|---|---|
| ***E02D 27/52*** | (2006.01) |
| ***E02D 27/10*** | (2006.01) |
| ***E02D 27/50*** | (2006.01) |
| ***E02B 17/02*** | (2006.01) |
| ***E02B 17/08*** | (2006.01) |
| *E02B 17/00* | (2006.01) |

(52) U.S. Cl.

CPC ..... *E02D 27/525* (2013.01); *E02B 17/021* (2013.01); *E02B 17/0818* (2013.01); *E02D 27/10* (2013.01); *E02D 27/50* (2013.01); *E02B 2017/006* (2013.01); *E02B 2017/0082* (2013.01)

(58) Field of Classification Search

CPC ..... E02D 27/52; E02D 27/525; E02D 27/50; E02D 27/10; E02B 17/02; E02B 2017/0082; E02B 2017/0056; E02B 17/021; E02B 2017/006; E02B 2017/0078; E02B 17/00; E02B 17/0818

USPC ..... 405/224, 203, 226

See application file for complete search history.

(56) References Cited

U.S. PATENT DOCUMENTS 2,941,369 A * 6/1960 Quirin ..... E02B 17/021 405/200

3,686,811 A * 8/1972 Hayes ..... E02B 17/0008 52/223.2

(Continued)

FOREIGN PATENT DOCUMENTS

SG WO2012121674 A1 9/2012

OTHER PUBLICATIONS

P.B. Hansen, L. Kellezi, and H.W.L. Hofstede, Jack-up footing penetration and fixity analyses, Aug. 2009, Frontiers in Offshore Geotechnics, pp. 559-565.*

(Continued)

*Primary Examiner* — John Kreck
*Assistant Examiner* — Carib Oquendo
(74) *Attorney, Agent, or Firm* — Pyprus Pte Ltd

(57) ABSTRACT

A modified spudcan with optimal peripheral skirt for enhanced performance of jackup operations comprises a spudcan top part, a spudcan bottom part, wherein the spudcan bottom has a central tip protruding from the central part of the spudcan bottom; wherein the top and bottom parts are coupled at their peripherals or through a spudcan side wall to form a hull structure, and a peripheral skirt having an upper end being coupled to the spudcan bottom part and a lower end extending downwardly, wherein the tip of the lower end of the peripheral skirt is higher than the distal end of the central tip.

8 Claims, 8 Drawing Sheets

(56) References Cited

U.S. PATENT DOCUMENTS

| | | | | | |
|---|---|---|---|---|---|
| 4,109,477 | A * | 8/1978 | Vogel | E02B 17/02 | 405/207 |
| 5,011,335 | A * | 4/1991 | Fjeld | E02B 17/021 | 405/195.1 |
| 5,224,798 | A * | 7/1993 | Thomas | E02B 17/021 | 405/196 |
| 5,852,985 | A * | 12/1998 | Fisher | B63B 21/26 | 114/296 |
| 6,099,207 | A * | 8/2000 | Bennett | E02B 17/021 | 405/196 |
| 8,668,408 | B2 | 3/2014 | Foo et al. | | |
| 2008/0279637 | A1 * | 11/2008 | Thomas | E02B 17/021 | 405/224 |
| 2009/0269144 | A1 * | 10/2009 | Foo | E02B 17/00 | 405/224.1 |
| 2009/0297276 | A1 * | 12/2009 | Foo | B63B 21/27 | 405/224 |
| 2010/0050764 | A1 * | 3/2010 | Foo | E02D 1/025 | 73/170.32 |

OTHER PUBLICATIONS

International Search Report of International Application No. PCT/SG2014/000266 completed Aug. 1, 2014 and mailed Aug. 1, 2014 (4 pages).

Written Opinion of International Application No. PCT/SG2014/000266 completed Aug. 1, 2014 and mailed Aug. 1, 2014 (5 pages).

International Preliminary Report on Patentability of International Application No. PCT/SG2014/000266 completed May 4, 2015 (12 pages).

Yu. L et al., "Mitigation of Punch-through Failure of Spudcan using Skirted Footing on Sand over Clay Soils", Proceedings of the twentieth (2010) International Offshore and Polar Engineering Conference. Retrieved from internet <URL: http://e-book.lib,sjtu.edu.cn/isope2010/data/papers/10TPC-1147Yu.pdf>. Published 2010. Fig 1, Conclusion.

* cited by examiner (a)

(b)

(a)

(b)

(c)

(d)

(e)

(a)

(b)

MODIFIED SPUDCAN WITH OPTIMAL PERIPHERAL SKIRT FOR ENHANCED PERFORMANCE OF JACKUP OPERATIONS

FIELD OF THE INVENTION

The present invention relates to a modified spudcan with optimal peripheral skirt for enhanced performance of jackup operations.

BACKGROUND OF THE INVENTION

A jackup rig is widely used in offshore exploration for drilling wells and gas/oil production. With the increase of demand of energy, the offshore exploration is moving more and more toward the locations where hazards are present. Therefore, the operability range of a jackup rig is critical for its performance.

A jackup rig usually comprises a floatable hull with a deck or working platform, and three or four legs, where the legs' bottom is coupled with footing(s), providing support for the hull in elevated conditions. After the jackup rig arrives on location, the legs are lowered until the footing(s) touch the underneath seabed and rest on the seabed soil. A preloading is then carried out to simulate the anticipated vertical footing load during design storm and to proof test the foundation soil. During preloading, the jackup is elevated to a minimum clearance above the water and ballast water is added into the hull to impose more gravity load onto the footing. The footing will keep penetrating the seabed until the soil bearing capacity can equate the preload imposed by the footing. After a stable penetration is achieved, the ballast water is removed and the hull may then be jacked up using a jacking system to raise the working platform above the water, making the jackup rig safe to be operated in environmental conditions which impose additional loads on the jackup.

The legs of a jackup rig are commonly tubular columns or trusses, each truss leg comprising vertical chords connected with cross braces that are normally diagonally disposed. The legs normally terminate in a jackup footing that rests on the seabed. The footing provides an enlarged bearing area so as to provide an adequate bearing capacity and reduce the pressure exerted on the seabed soil. Resultantly, this reduces the penetration depth of the legs that is required by the foundation to support the jackup rig, allowing the jackup rig to be operated in a greater variety of locations and soil types with the available leg length.

Modern jackup rigs are typically equipped with individual footings, often referred to as "spudcan", which are connected to each leg of the jackup rig. This allows the jackup rig to be supported on uneven seabeds or slopes or in the cases whereby the elevation of each leg is needed to be independently adjusted relative to the other legs. As shown in FIG. 1, a traditional spudcan 10 is typically having a generally conical upper half 11 connected to the leg A and a generally conical lower half or base 12 for contact with the seabed, where the conical upper and lower halves are usually coupled directly at their peripheral or through a spudcan side wall 13. The conical base helps ensure some penetration into the seabed, even in hard soils, so as to provide some anchoring of the legs into the seabed. Alternative to the conical shape, the upper and lower half can also consist of three or more sloping plates. The spudcan 10 further comprises a central tip or spigot 14 that is located at the bottom of the lower half 12. The central tip or spigot 14 is designed for providing a shear key for penetration in soft rock or hard soil. The conical or sloping bottom, rather than a flat base, is to help ensure the support point as concentric as possible for partial embedment case in the anticipation of not perfectly flat seabed.

During spudcan touch-down, the central tip and conical bottom will encounter gradually increasing resistance in both vertical and lateral direction as the spudcan penetrates the seabed. This is favorable as the gradual increase of resistance force allows for greater penetration into the soil, increasing the ability of the soil to absorb energy without producing large reaction forces. In addition as the spudcan penetrates further, the additional hull buoyancy is mobilized, providing an additional source of energy dissipation and further reducing the peak impact force experienced. Despite its robustness for installation, the traditional spudcan may not be able to provide the maximum fixity (the amount of rotational restraint provided by the spudcan) in dense sand or hard soil due to the conical bottom nature and the limited amount of preload that a jackup can impose. In this case, the spudcan full diameter cannot be fully utilized and the partial contact results in much lower fixity.

Skirted spudcan is normally used to increase the bearing capacity and hence fixity in dense sand compared to that of the traditional spudcans (without skirt). The skirt effectively provides an "embedment" effect which could have been achieved by forcing a flat-based spudcan (without skirt) to the same penetration level as the skirt depth. As shown in FIG. 2, a spudcan with a typical skirt 20 is similar to the traditional spudcan for having the conical upper half 21 connected to the leg A, a lower half with a single or double sloped bottom 22, a spudcan side wall 23 connecting both halves 21, 22, and a central tip or spigot 24 with additions of a peripheral skirt 25 and an internal skirt 26. For circular spudcans, the skirt height could be uniform around the entire perimeter if the spudcan bottom is of conical shape or varying in height when the lower half is formed of multiple sloping plates. Nonetheless, the lowest tip point of the normal skirt is typically lower than or at least flush with the lowest point of the central tip.

Despite its advantages in increasing the fixity for sandy seabed condition, the relatively long skirt can impose problems when the jackup encounters soft or hard seabed. For example, in soft seabed, the relatively long skirt may create leg extraction problem due to the increased frictional resistance of the skirt surface and suction effect. Furthermore, the spudcan with relatively long skirt is not suitable for hard or rock seabed. When the skirt encounters a hard layer without having the spudcan base in sufficient contact with the seabed, the skirt tip effectively becomes the support point. This would impose very high stress and potentially damage the skirt. In addition, unless the hard seabed is perfectly flat the peripheral skirt tip may only partially contact the hard layer, creating eccentric load on the spudcan. This situation is undesirable as the bending moment created by the eccentric support at the spudcan level may impose substantial initial stress at the leg even in the static condition before withstanding the design storm.

Another potential disadvantage of the spudcan with relatively long skirt could occur during lowering the jackup legs at very stiff or hard clay. Roll or pitch motions of the jackup will result in both vertical and horizontal motions of the spudcan as it impacts the seabed. Compared to the traditional conical-bottomed spudcan with a central tip, the skirt will attract a much larger horizontal resistance. Since the laterally projected width of the skirted spudcan is constant as it impacts and penetrates the seabed, the resulting horizontal resistance becomes large. The horizontal resistance may then become the controlling aspect for the utilization of the leg holding system capacity. The skirt may also damage upon impact on rock seabed.

In order to increase the stability of the spudcan for a specific soil condition, Keppel has disclosed a spudcan comprising an elongated skirt with openings at the top half of the skirt (PCT application, PCT/SG2012/000075). The tip of the elongated skirt is lower (i.e., longer) than the tip of the bottom central protrusion. Such a spudcan has advantages for installation particularly at soft clay overlying hard stratum as it allows the trapped soil to flow out through the side openings on the skirt and ensure sufficient skirt embedment into the hard stratum. However, for other soil conditions, this concept is not an ideal solution and the relatively long skirt may limit the jackup performance.

SUMMARY OF THE INVENTION

One aspect of this invention is to provide a modified spudcan with optimal peripheral skirt for enhanced performance of jackup operations.

In one embodiment, the spudcan with optimal peripheral skirt comprises a spudcan top part, a spudcan bottom part, wherein the spudcan bottom has a central tip protruding from the central part of the spudcan bottom; wherein the top and bottom parts are coupled at their peripherals to form a hull structure, and a peripheral skirt having an upper end being coupled to the spudcan bottom part and a lower end extending downwardly, wherein the tip of the lower end of the peripheral skirt is higher than the distal end of the central tip.

In another embodiment, the spudcan further comprises a spudcan side wall disposed between the spudcan top and bottom parts so as to connect the spudcan top and bottom parts to form a hull structure.

In another embodiment, the top part has a flat surface or a conical or multiple sloping planes configurations. In yet another embodiment, the bottom part has a flat base or conical or multiple sloping planes configurations.

In another embodiment, the height of the peripheral skirt is correlated to both the diameter of the spudcan and vertical height of the spudcan bottom part, and wherein an angle between the slope from the distal end of the central tip to the tip of the lower end of the peripheral skirt and the horizontal line radially extending from the distal end of the central tip ranges from 2 to 25 degrees.

Another aspect of the invention is to provide a jackup platform. In one embodiment, the jackup platform comprises a platform on which accessories are disposed; a plurality of legs for supporting the platform; and a plurality of spudcans with optimal skirt, wherein one spudcan is attached to the bottom end of one leg; wherein the spudcan with optimal skirt comprises a spudcan top coupled to one of the plurality of legs; a spudcan bottom part, wherein the spudcan bottom has a central tip protruding from the central part of the spudcan bottom; wherein the top and bottom parts are coupled at their peripherals to form a hull structure; and a peripheral skirt having an upper end being coupled to the spudcan bottom part and a lower end extending downwardly, wherein the tip of the lower end of the peripheral skirt is higher than the distal end of the central tip.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

One aspect of the present invention provides a modified spudcan with optimal peripheral skirt for enhanced performance of jackup operations. Briefly, the bottom end of the skirt is higher than the bottom end of the central protrusion/tip. The optimal skirt spudcan is versatile at various stages of jackup operations. The height of the skirt is dependent upon design requirement for specific application; the factors that could be considered in designs include: i) spudcan diameter, ii) overall height of the spudcan bottom which also includes the central tip, iii) skirt tip height from the maximum bearing area, iv) a slope between the central tip and skirt tip, and v) the corresponding spudcan bottom bearing area at the skirt tip level.

Figure 1:
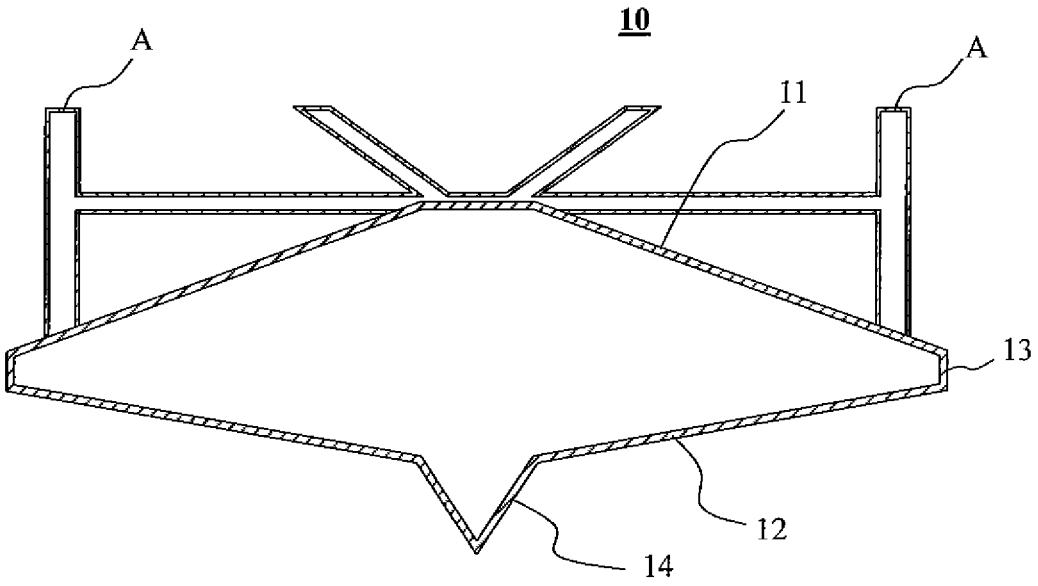
FIG 1 (Prior Art)
FIG. 1 shows a cross-sectional view of a traditional spudcan in the prior arts.
Figure 2:
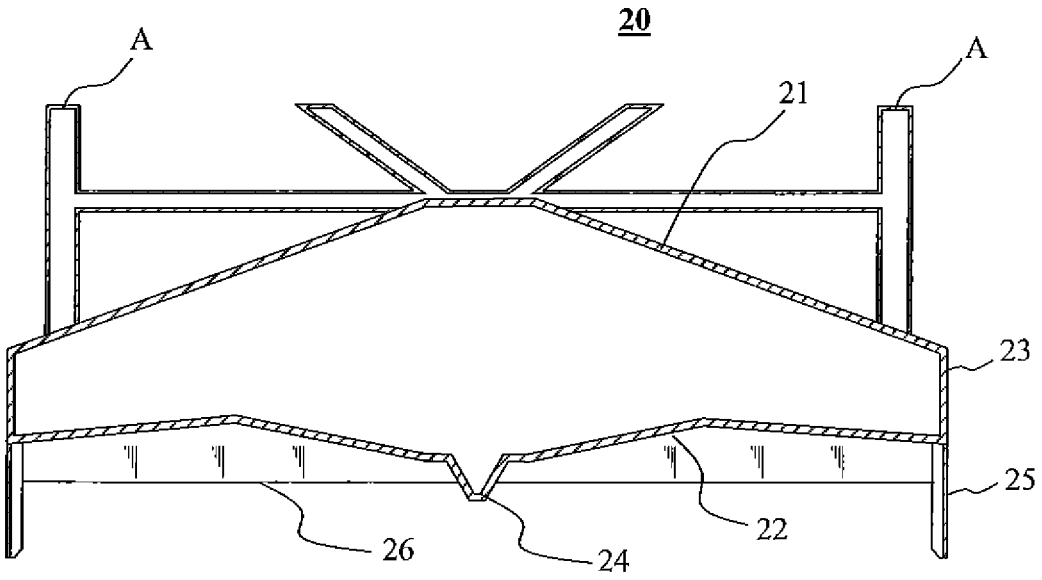
FIG 2 (Prior Art)
FIG. 2 shows a cross sectional view of a spudcan with a typical skirt in the prior arts.
Figure 3:
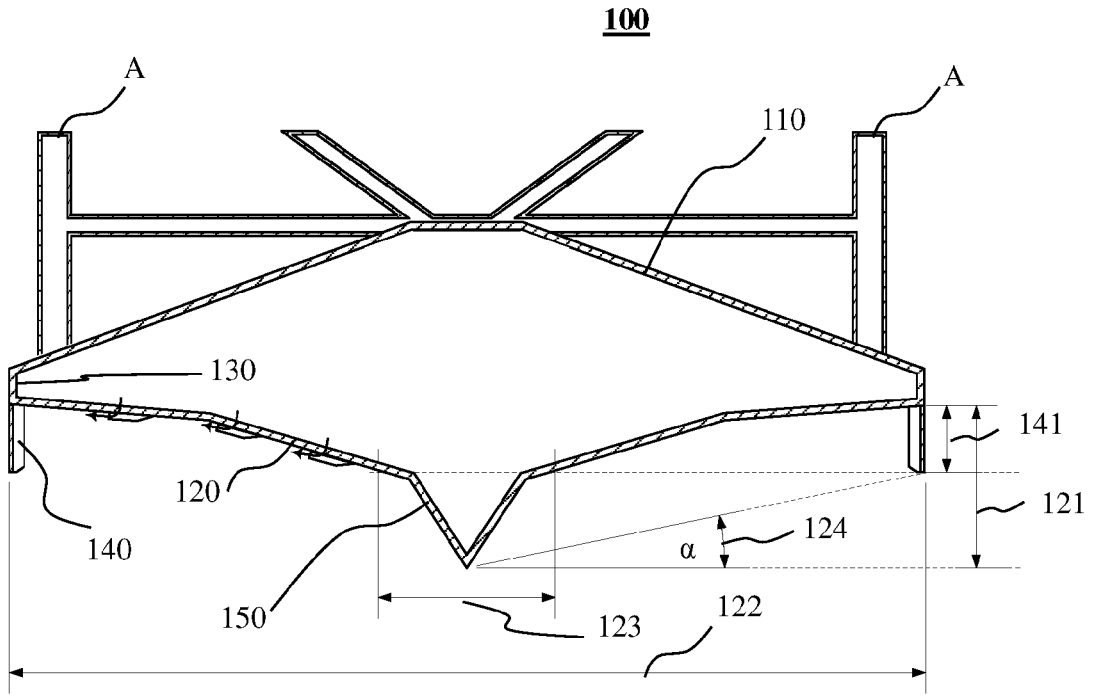
FIG. 3 shows cross sectional views of a spudcan with optimal skirt in accordance with the embodiments of the present invention.
Figure 3:
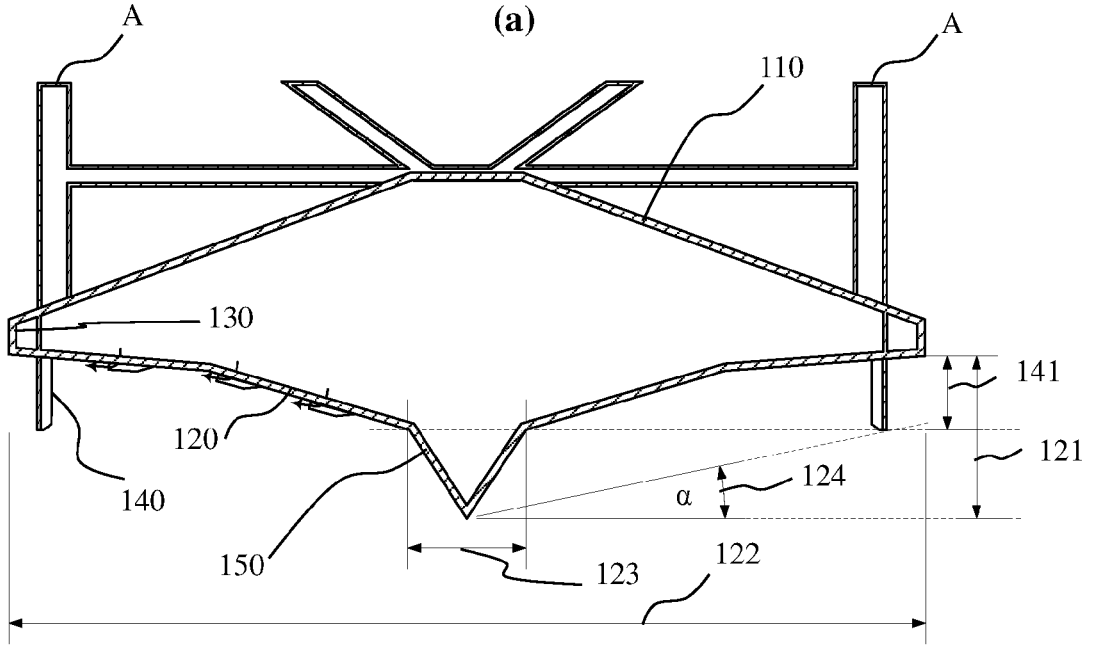

Referring now to FIG. 3, there is provided a cross sectional view of a spudcan with optimal skirt in accordance with one embodiment of the present invention. The spudcan with optimal skirt 100 comprises a spudcan top part 110, a spudcan bottom part 120, a spudcan side wall 130, and a peripheral skirt 140. The spudcan top part 110 can be conical or multiple sloping planes configurations; when utilized in a jackup platform, it is coupled with the leg A of the jackup platform for supporting one leg of a jackup rig. The spudcan bottom part 120 can be a flat base, or a conical or multiple sloping planes configuration with a downward slope. In one embodiment, it has a double-sloped configuration. The spudcan bottom part 120 has a central tip 150 protruding from the central point of the spudcan bottom. The spudcan side wall 130 connects the top 110 and bottom 120 to form a hull structure. In certain embodiments, the spudcan side wall 130 is omitted, so that the spudcan top 110 and bottom 120 are coupled at their peripherals to form an outer edge.

The peripheral skirt 140 has an upper end being integrally coupled to the spudcan bottom. The skirt and side wall are typically flush (FIG. 3*a*), but the coupling point between the skirt and spudcan bottom can be varied; for example, the skirt is placed slightly radially inward as shown in FIG. 3*b*. The peripheral skirt 140 also has a lower end being downwardly projected so that the peripheral skirt 140 encircles the spudcan bottom part 120, wherein the distal end of the central tip 150 in the spudcan bottom is lower than the tip of the lower end of the peripheral skirt 140. The height ($H_s$) 141 of the peripheral skirt 140 is correlated to both the diameter 122 of the spudcan 140 and vertical height ($H_t$) 121 of the spudcan bottom 120. The angle ($\alpha$) 124 between the slope from the distal end of the central tip 150 to the tip of the peripheral skirt 140 and the horizontal line radially extending from the distal end of the central tip 150 ranges from 2 to 25 degrees, preferably from 5 to 25 degrees, and more preferably 10 to 20 degrees. The minimum skirt height ensures sufficient confinement for void filling purposes and minimum scour protection. The effective spudcan diameter at the skirt tip level 123 can vary of the diameter of the peripheral skirt 122 between 1% and 75%, preferably between 5% and 50%, and more preferably 10% and 30%. Having too small or too big area beyond this range may compromise some of the performances mentioned above.

The optimal skirt spudcan 100 can be made of any suitable materials and assembled in any suitable manner. The materials and assembly are commonly known in the art; therefore no further details will be provided herein in order not to obscure the principles of the present invention.

The skirt height can be configured to facilitate full bottom contact or to provide "embedment effect" during in-place condition. In other words, the main benefit of normal skirted spudcan for increasing fixity in dense sand seabed can be preserved. Similarly, for installations at very stiff clay, where partial bottom contact would have been expected using traditional spudcans, the skirt enables void filing to achieve the full contact. This will in turn maximize the horizontal sliding capacity particularly at the clayey soil as well as the fixity of the spudcan.

At the same time, during spudcan touch-down on the seabed, the central tip and the conical bottom are made to predominantly control the interaction with seabed. This adopts the advantage of the traditional spudcans as described in earlier section. By minimizing the contact with the skirt and attracting less spudcan horizontal resistance during initial stage of impact, the jackup performance during installation particularly on hard seabed is not compromised by the skirt presence.

Having the skirt tip higher than the bottom of the central tip will ensure most, if not all, of the spudcan reaction forces is taken by the central tip when the spudcan is sitting on hard soil or rock seabed with very shallow penetration. The optimal skirt will prevent the skirt from being the supporting point which could create eccentric loading on the spudcan. As the skirt tip is higher than the bottom of the central tip, the central tip will become the support and the potential for the skirt tip reacts against the seabed can be minimized. This also applies when the jackup is resting on undulating or sloping seabed.

During extraction in clayey seabed, the skirt is used to improve the effectiveness of water jetting system at the spudcan bottom (compared to a traditional spudcan) and the additional friction resistance from the skirt is minimized (compared to a long skirted spudcan). Confining the jetting pressure will help ensure more uniform pressure distribution across the spudcan bottom and thus it can more effectively compensate suction pressure or provide uplift thrust at the spudcan bottom.

An optimum configuration will help ensure favorable performance of the spudcan at various conditions: e.g. i) touch-down during installation, ii) sitting on undulating/sloping seabed, iii) void filling after installation, iv) scouring protection during in-place, v) fixity during in-place, and vi) uplift resistance and water jetting confinement during leg extraction.

Figure 4:
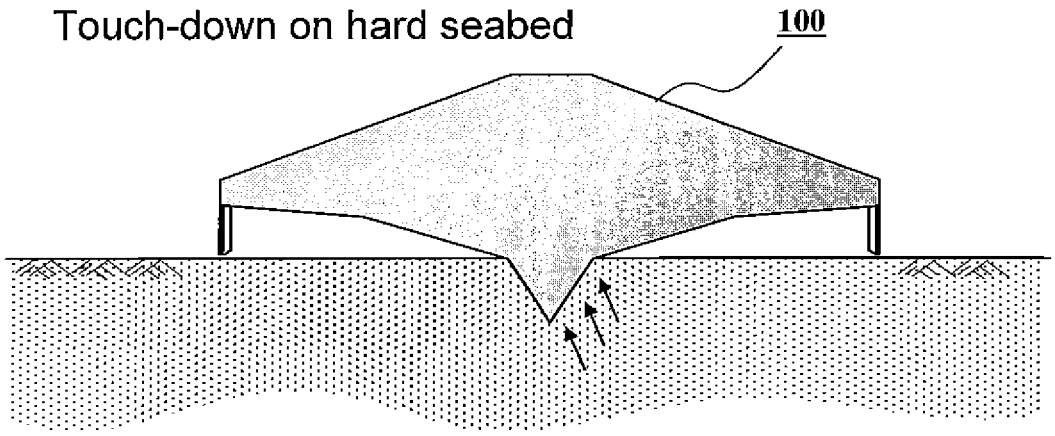
FIG. 4 illustrates the exemplary situations where the spudcan with optimal skirt of the present invention is used.
Figure 4:
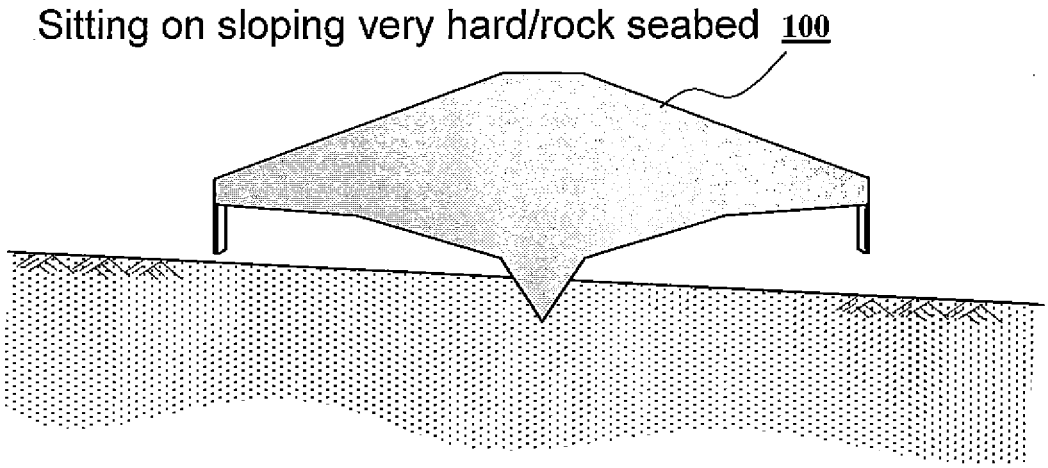
Figure 4:
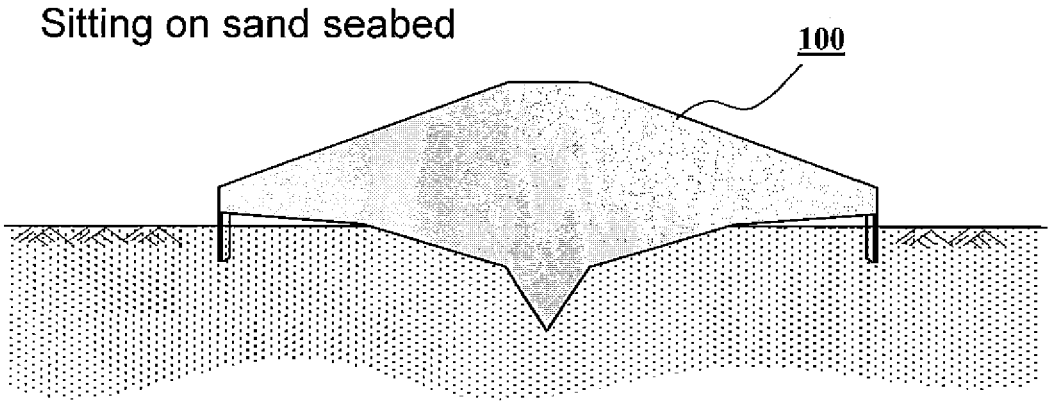
Figure 4:
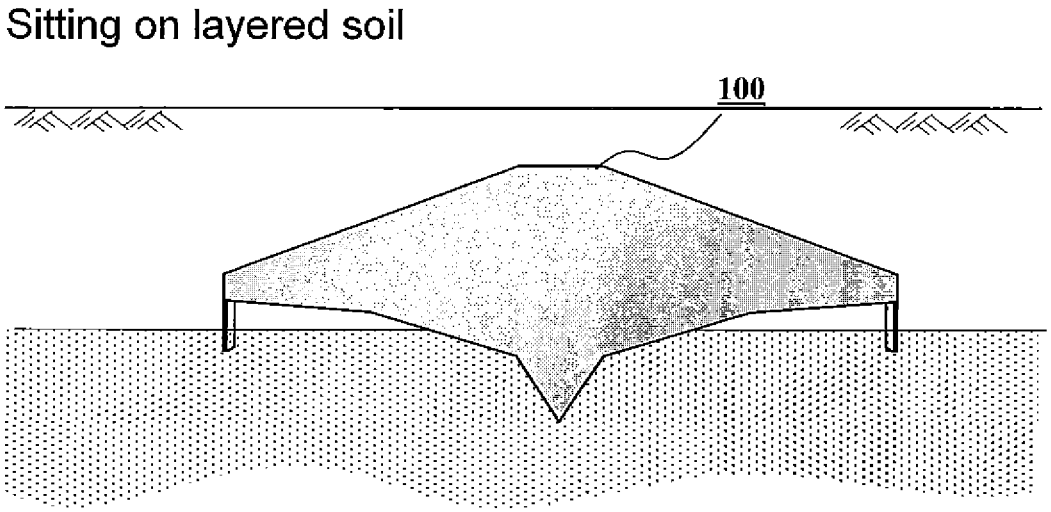
Figure 4:
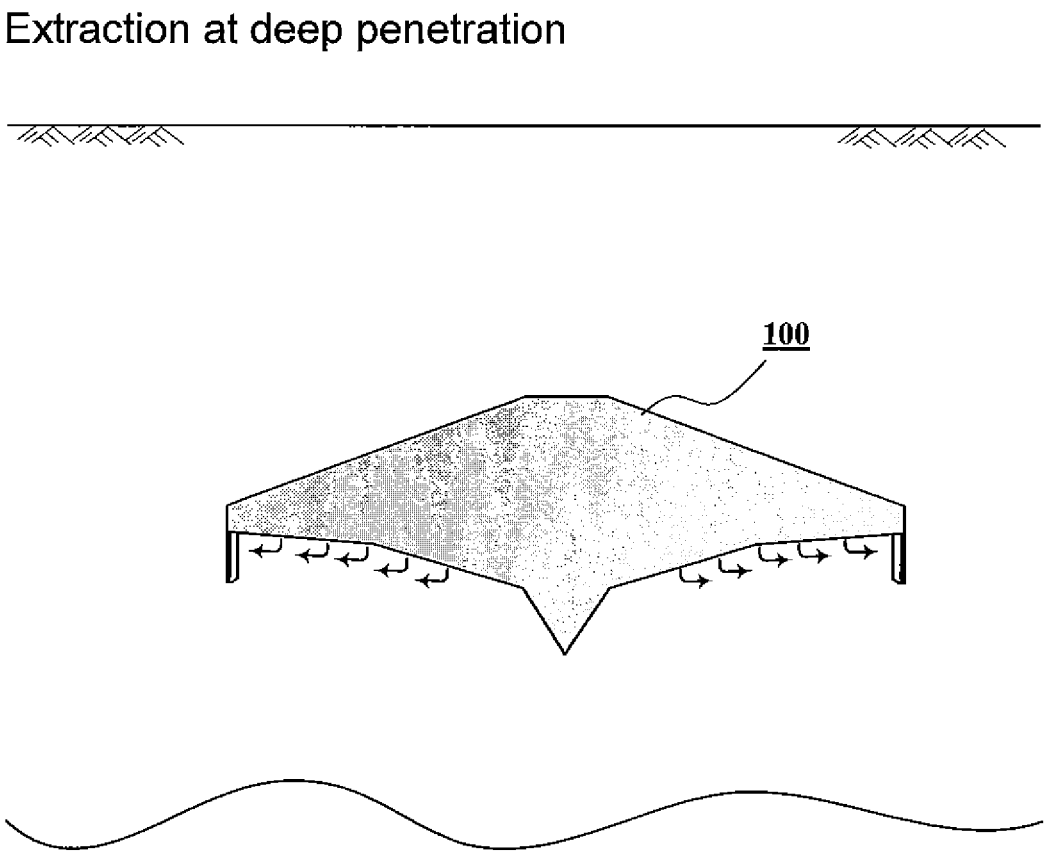

Referring now to FIG. 4, there is provided illustrative views showing the application of the operation of the optimal skirt spudcan in various situations. In FIG. 4A, during spudcan touch-down on hard seabed, the central tip will react against the seabed. The interaction of seabed on the skirt during initial stage of impact, which is often the most critical, can be prevented and thus attracting less impact force. In FIG. 4B, when the jackup is sitting on sloping very hard or rock seabed to a certain degree, it can be ensured that the central tip becomes the supporting point and the potential eccentric load due to the skirt tip reacting against the seabed can be minimized. A situation where the jackup is installed on sand seabed is also illustrated in FIG. 4C. Apart from providing a minimum scour protection, the skirt also maintains the main benefit of increased fixity resulting from the full contact area and "embedment" effect. Where required, the skirt facilitates void filling to achieve the full contact by injecting barite or other substances through jetting lines. FIG. 4D shows the spudcan installed in soft clay overlying very stiff seabed. The skirt improves the horizontal sliding capacity by providing embedment into the very stiff layer and increased lateral projected area. If the trapped clay between the spudcan bottom and the hard seabed is considered stiff enough and confined by the skirt, this would be able to increase the fixity. FIG. 4E illustrates how the water jetting at the spudcan bottom area can be confined by the optimal skirt during leg extraction. The confinement of the pressure radiated from the jetting nozzles will help ensure more uniform pressure distribution across the spudcan bottom and thus it can more effectively compensate suction pressure or provide uplift thrust at the spudcan bottom.

Figure 5:
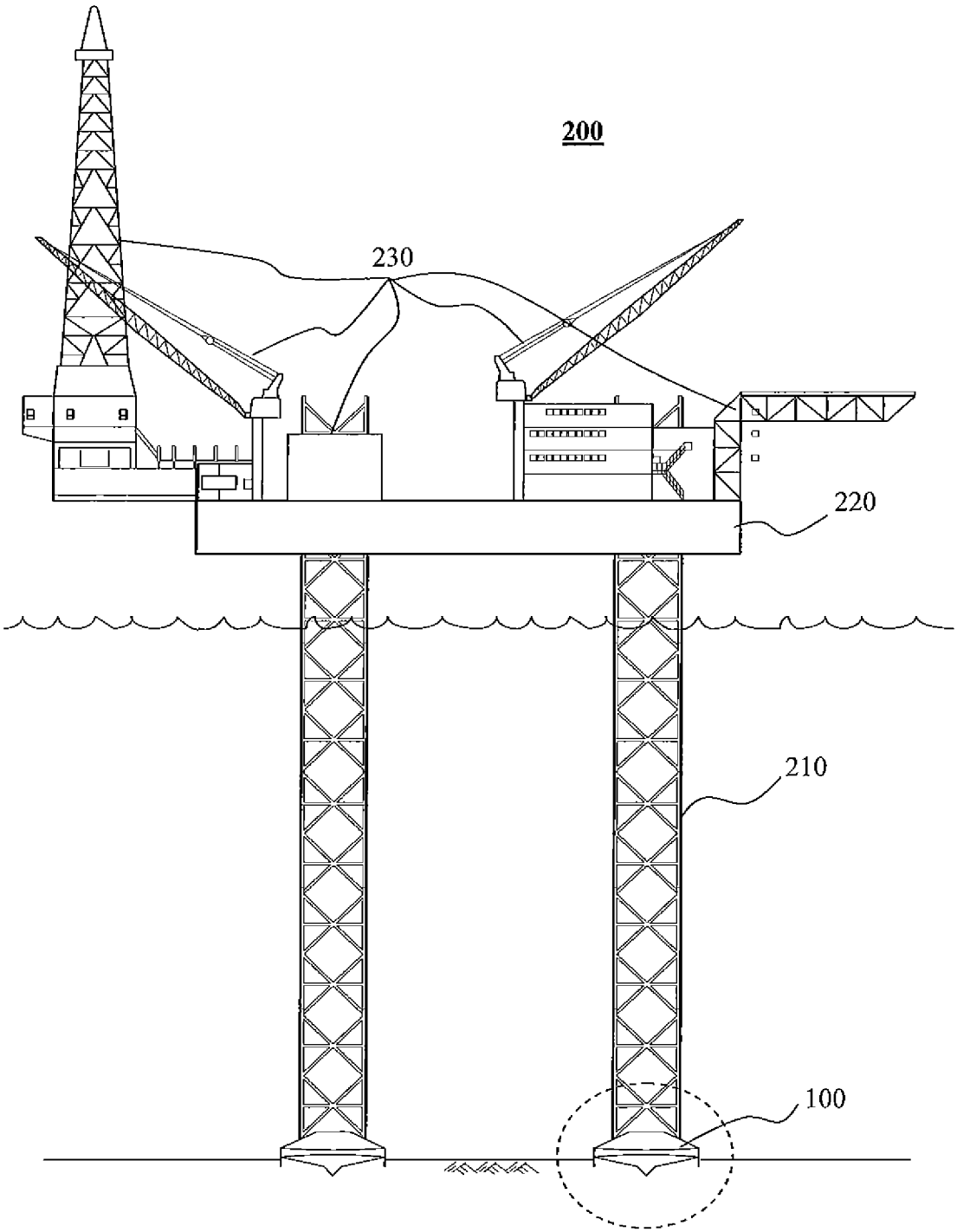
FIG. 5 shows a side view of a jackup platform employing the optimal skirt spudcan (a), and an isometric view of the coupling between a leg of the jackup rig and an optimal skirt spudcan in accordance with one embodiment of the present invention (b).
Figure 5:
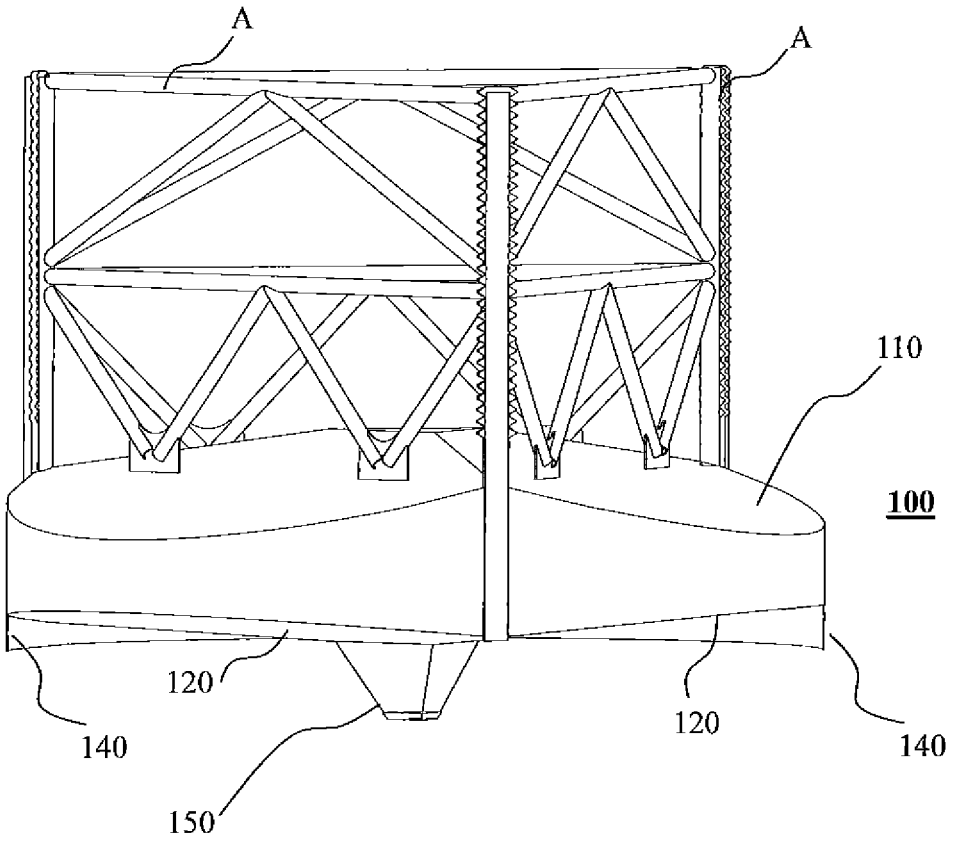

Referring now to FIG. 5, there is provided a side view of a jackup platform employing the optimal skirt spudcan (a), and an isometric view of the coupling between a leg of the jackup rig and an optimal skirt spudcan in accordance with one embodiment of the present invention (b). FIG. 5*a* shows a jackup platform 200 comprises a plurality of legs (4 legs shown) 210 of which each is coupled with a spudcan 100 detailed in FIG. 5*b*, a platform 220 being supported by the plurality of legs 210, and accessories 230. A three-chorded truss leg of the jackup is connected to a circular spudcan with optimal skirt. The spudcan top and bottom are made of three sloping plates with a central tip protrusion at the spudcan bottom. The peripheral skirt is coupled to the spudcan bottom immediately below the spudcan wall. The tip of the lower end of the peripheral skirt is higher than the distal end of the central tip.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A spudcan with optimal skirt, comprising:

a spudcan top part;

a spudcan bottom part, wherein the spudcan bottom has a central tip protruding from central part of the spudcan bottom; wherein the top and bottom parts are coupled at their peripherals to form a hull structure; and a peripheral skirt having an upper end being coupled to the spudcan bottom part and a lower end extending downwardly, wherein tip of the lower end of the peripheral skirt is higher than distal end of the central tip.

2. The spudcan of claim 1, further comprising a spudcan side wall disposed between the top and bottom parts so as to connect the spudcan top and bottom parts to form the hull structure.

3. The spudcan of claim 1, wherein the top part has a flat surface or conical or multiple sloping planes configurations.

4. The spudcan of claim 1, wherein the bottom part has a flat base or conical or multiple sloping planes configurations.

5. The spudcan of claim 1, wherein the height of the peripheral skirt is correlated to both diameter of the spudcan and vertical height of the spudcan bottom part, and wherein an angle between a slope from the distal end of the central tip to the tip of the lower end of the peripheral skirt and a horizontal line radially extending from the distal end of the central tip ranges from 2 to 25 degrees.

6. The spudcan of claim 5, wherein the angle is between 5 to 25 degrees.

7. The spudcan of claim 5, wherein the angle is between 10 to 20 degrees.

8. A jackup platform, comprising:

a platform on which accessories are disposed;

a plurality of legs for supporting the platform; and a plurality of spudcans with optimal skirt, wherein one spudcan is attached to the bottom end of one leg;

wherein the spudcan with optimal skirt comprises:

a spudcan top coupled to one of the plurality of legs;

a spudcan bottom part, wherein the spudcan bottom has a central tip protruding from central part of the spudcan bottom; wherein the top and bottom parts are coupled at their peripherals to form a hull structure; and a peripheral skirt having an upper end being coupled to the spudcan bottom part and a lower end extending downwardly, wherein tip of the lower end of the peripheral skirt is higher than distal end of the central tip.

* * * * *